US008287297B2

(12) United States Patent
Schmidt et al.

(10) Patent No.: US 8,287,297 B2
(45) Date of Patent: Oct. 16, 2012

(54) CLEARANCE COMPENSATION UNIT

(75) Inventors: Ralf Schmidt, Furth (DE); Werner Boeck, Gross Umstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 13/068,206

(22) Filed: May 5, 2011

(65) Prior Publication Data

US 2011/0275234 A1 Nov. 10, 2011

(30) Foreign Application Priority Data

May 6, 2010 (DE) ..... 10 2010 028 672

(51) Int. Cl.
*H01R 24/00* (2006.01)

(52) U.S. Cl. ..... 439/345

(58) Field of Classification Search ..... 439/345, 439/676, 352–355, 347, 330, 331
See application file for complete search history.

(56) References Cited

U.S. PATENT DOCUMENTS

| | | | | |
|---|---|---|---|---|
| 3,539,965 | A * | 11/1970 | Morehart et al. | 439/75 |
| 4,534,603 | A * | 8/1985 | Brown et al. | 439/82 |
| 4,934,965 | A * | 6/1990 | Buddrus et al. | 439/845 |
| 5,232,382 | A * | 8/1993 | Karlovich | 439/843 |
| 6,283,796 | B1 * | 9/2001 | Yeh | 439/677 |
| 6,296,528 | B1 * | 10/2001 | Roberts et al. | 439/676 |
| 6,334,781 | B1 * | 1/2002 | Nishio et al. | 439/76.1 |
| 6,682,364 | B2 * | 1/2004 | Cisey | 439/441 |
| 6,699,071 | B1 * | 3/2004 | Hyland | 439/607.19 |
| 6,957,984 | B1 * | 10/2005 | Huang | 439/676 |
| 6,966,798 | B1 * | 11/2005 | Wu | 439/677 |
| 6,976,870 | B1 * | 12/2005 | Li | 439/541.5 |
| 7,037,141 | B1 * | 5/2006 | Huang | 439/676 |
| 7,108,563 | B2 * | 9/2006 | Sato et al. | 439/676 |
| 7,311,562 | B2 * | 12/2007 | Leong et al. | 439/767 |
| 7,390,204 | B2 * | 6/2008 | Tanaka et al. | 439/159 |
| 7,390,227 | B2 * | 6/2008 | Hsu et al. | 439/676 |
| 7,645,153 | B1 * | 1/2010 | McCauley et al. | 439/260 |

FOREIGN PATENT DOCUMENTS

| | | | |
|---|---|---|---|
| DE | 295 05 601 | U1 | 5/1995 |
| DE | 10 2004 002 402 | B3 | 11/2005 |

OTHER PUBLICATIONS

International Search Report issued by the German Patent and Trademark Office for DE 102010028672.9 on Dec. 7, 2010; 6 pages.

* cited by examiner

*Primary Examiner* — Alexander Gilman
(74) *Attorney, Agent, or Firm* — Faegre Baker Daniels LLP

(57) ABSTRACT

The invention relates to a clearance compensation unit for a plug connection, in particular an electrical RJ plug connection, comprising a plug connector and a counter connector, the clearance compensation unit comprising a clearance compensation spring which has at least two spring portions in such a way that clearance between the plug connector and the counter connector can be compensated in at least two dimensions by means of the spring portions, it being possible to push the plug connector against another spring portion of the clearance compensation spring or against a limit stop of the counter connector. The invention further relates to a plug connector; a counter connector; in particular a plug, a built-in plug, a coupling or a socket; a housing therefor; or a support collar; preferably for an electrical RJ plug connection, comprising a clearance compensation unit according to the invention.

20 Claims, 9 Drawing Sheets

(Stand der Technik)

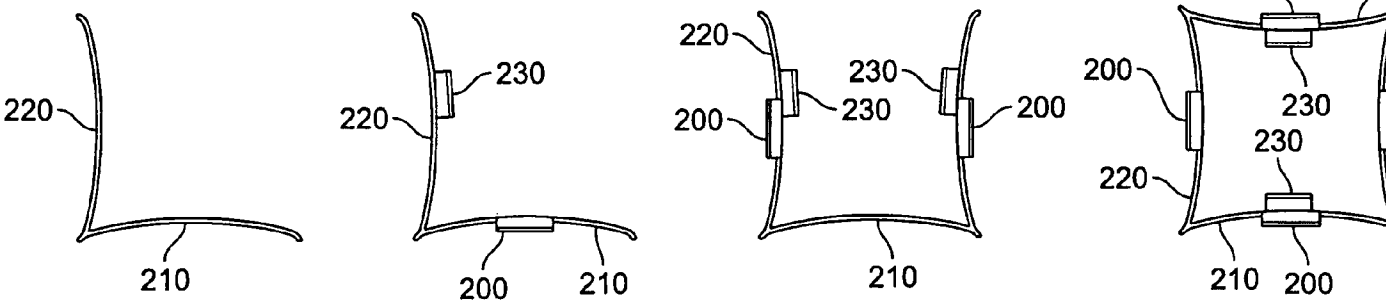
Fig. 11
Fig. 12
Fig. 13
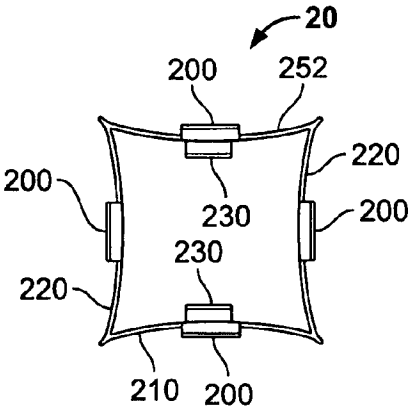
Fig. 14
Fig. 15
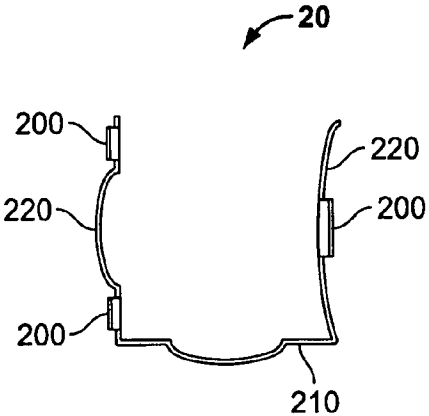
Fig. 16
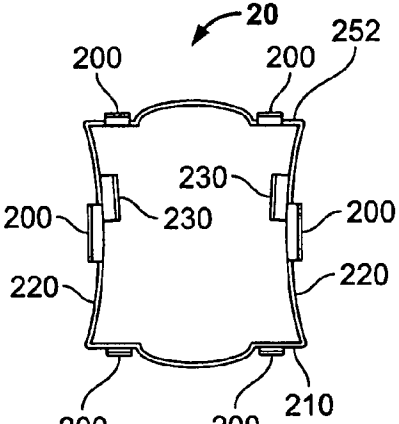
Fig. 17
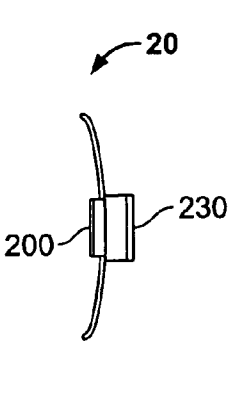
Fig. 18

CLEARANCE COMPENSATION UNIT

The invention relates to a clearance compensation unit for a plug connection, in particular an electrical RJ plug connection, comprising a plug connector and a counter connector. The invention further relates to a plug connector; a counter connector; in particular a plug, a built-in plug, a coupling or a (built-in) socket; a housing therefor; or a support collar; preferably for an electrical RJ plug connection, comprising a clearance compensation unit according to the invention.

In electronics and/or electrical engineering, a large number of electrical contact connectors, pin connectors and/or socket connectors—hereinafter referred to as (electrical) plug connectors and (electrical) counter connectors—are known which are used to transmit electrical power and/or electrical signals having as large a bandwidth as possible of voltages, currents, frequencies and data rates. Plug connectors and counter connectors of this type can be provided on a cable or another piece of electrical equipment, for example a circuit board, or on/in a housing or support collar of an electrical or electronic appliance. If a plug connector or counter connector is located on a cable, it is usually referred to as a plug or a coupling; if it is located on/in an electrical/electronic device, it is usually referred to as a built-in plug or a (built-in) socket. A counter connector is also often referred to as a plug receptacle, in particular when a counter connector comprises a support collar for providing a more robust connection between the plug connector and the counter connector.

The electrical plug connector and counter connector must permanently ensure a perfect transmission of electrical signals and electrical power, mutually corresponding plug connectors and counter connectors usually comprising mounting or locking means for mounting or locking the plug connector in/on the counter connector in a permanent but generally releasable manner. A plug connector is advantageously mounted in or on a counter connector by a locking mechanism, the interconnection generally being provided automatically when the plug connector is inserted into the counter connector, in that a locking means of the plug connector and a locking means of the counter connector interlock. A locking mechanism of this type is generally readily releasable, the locking means of the plug connector being displaced in the counter connector relative to the corresponding locking means of the counter connector and transverse to an insertion direction of the plug connector of the plug connector, in such a way that the two locking means no longer interlock. When the plug connector is inserted in the counter connector, a tension-resistant connection between the two connectors can be produced simply and quickly via the locking mechanism and can subsequently be released.

DE 10 2004 038 123 A1 discloses an electrical plug connector, an electrical counter connector and a support collar for the counter connector, which together make possible a robust connection between the plug connector and the counter connector. In this case, the support collar arranged in front of the counter connector, which is actually formed as a socket, serves to improve the way in which the plug connector is held in the counter connector. For this purpose, the plug connector comprises, in addition to a locking means which corresponds to a locking means of the counter connector, a further locking means which in this case corresponds to a locking means of the support collar, which means together form a second locking mechanism. This second locking mechanism between the plug connector and the support collar reinforces a mechanical connection between the two connectors. The support collar is preferably arranged outside a wall of a housing of an electrical or electronic appliance, the support collar being snapped onto the housing in the insertion direction or being screwed to the housing.

The residual clearance inside a connection of this type made up of a plug connector and a counter connector is too large, in particular in the case of mechanical shock loading and/or repeated mechanical loading, it being possible for one of the two connectors to move relative to the other connector until electrical contact occurs inside a plug connection formed by the two connectors. This is disadvantageous for the service life of a contact connection between the electrical contact means in question and for a mechanical connection between the plug connector and the counter connector. In this case, simple and reliable mounting of the electrical connections to be produced inside the connectors, i.e. between the contact means of the connector—for example, electrical pin connectors, socket connectors, flat/laminated connectors or contact springs—and the contact means of the counter connector—including for example electrical socket connectors, pin connectors, flat/laminated connectors or contact springs—is to be ensured.

The object of the invention is to provide an improved plug connector and an improved counter connector, and an improved housing or an improved support collar therefor. According to the invention, clearance and tolerance compensation is to be provided for a plug connection, in particular an electrical RJ plug connection, which comprises a plug connector and a counter connector corresponding thereto. In this context, it should be possible to reduce the mechanical clearance between the connectors in two, but preferably three dimensions, orientations or directions and to reduce it to zero where possible, in such a way that mechanical loading on the plug connection cannot propagate to such an extent that electrical contact occurs inside the plug connection.

The object of the invention is achieved by means of a clearance compensation unit for a plug connection, in particular an electrical RJ plug connection, comprising a plug connector and a counter connector, according to claim 1, and by means of a plug connector; a counter connector; in particular a plug, a built-in plug, a coupling or a socket; a housing therefor; or a support collar; preferably for an electrical RJ plug connection, according to claim 10. Advantageous developments of the invention arise from the dependent claims.

The clearance compensation unit according to the invention comprises a clearance compensation spring according to the invention for a plug connection made up of a plug connector and a counter connector. The clearance compensation spring has at least two spring portions, in such a way that clearance and tolerance between the plug connector and the counter connector can be compensated in at least two dimensions, orientations or directions by means of the spring portions. In this case, the plug connector can be pushed or moved against a spring portion of the clearance compensation spring or against a limit stop of the counter connector by means of the clearance compensation spring. In this case, the clearance compensation spring is fixed rigidly in position in a relevant portion of the plug connector, in particular the counter connector, it being preferred for the clearance compensation spring to be accommodated, in particular locked and/or clamped, in a support collar for high mechanical requirements.

The clearance compensation spring, preferably a single spring formed in one piece, pushes or moves the plug connector located in the counter connector in at least two dimensions, orientations or directions. For this purpose, the clearance compensation spring has at least one spring portion for each particular dimension, orientation or direction. This can be, for example, an axial, a horizontal and/or a vertical direction. In this case, a respective horizontal compensation can have portions for a vertical compensation and vice versa, which is particularly expedient in cases where the terms horizontal and vertical cannot be unambiguously applied to a plug connection. Clearance between the plug connector and the counter connector can be compensated by the spring portions, in particular in three dimensions, orientations or directions which are preferably perpendicular to one another.

According to the invention, mechanical shock loading and/or repeated mechanical loading of an electrical plug connection can be increased significantly compared to the prior art, it being possible to keep an electrical connection inside the plug connection free from forces to a certain extent, thus increasing the service life of the electrical plug connection, i.e. according to the invention, abrasion of electrical contact means, in particular electrical contact springs, is at least minimised and preferably prevented.

According to the invention, mechanical clearance and dimensional tolerance of the plug connector relative to the counter connector or of the counter connector relative to the plug connector can be reduced in at least two, but preferably three dimensions, orientations or directions, in particular can be reduced to substantially zero. According to the invention, this can take place with low investment costs, since for example existing support collars need merely be equipped with a single clearance compensation spring to achieve the effect according to the invention. That is to say, the invention can be applied to all existing support collars and also to new ones. Of course, it is also possible to compensate clearance or tolerance in only one dimension, orientation or direction.

In preferred embodiments of the invention, a relevant spring portion of the clearance compensation spring is a planar spring portion. In this case, the relevant spring portion can comprise a disc spring, a spring shackle, a leaf spring, or a concave or convex curve or can be formed substantially entirely as a disc spring, a spring shackle, a leaf spring, or a concave or convex curve. A cross-section of the clearance compensation spring is preferably formed so as to be approximately I-, L- or U-shaped or closed and/or is in the form of a partial circle or a partial ellipse in portions. In this case, the clearance compensation spring is preferably configured as a single-piece cage spring which is open at least at the two end faces thereof and preferably also at the top face thereof. The spring portions are arranged inside the clearance compensation spring in such a way that clearance between the plug connector and the counter connector can correspondingly be compensated thereby. That is to say, the respective spring portion pushes or moves the entire plug connector in the relevant dimension, orientation or direction against another relevant spring portion of the clearance compensation spring or against the relevant limit stop in/on the counter connector.

The clearance compensation spring, which is configured as a cage spring, comprises at least one, preferably two, in particular three branches, said branches preferably being approximately perpendicular to one another if there are two or more branches. Each of the branches comprises at least one spring portion for the clearance compensation spring or the respective spring portion is provided by the relevant branch. According to the invention, the above-mentioned configurations of the respective spring portions can be provided in any desired manner on/in a relevant clearance compensation spring or the relevant spring portion of the clearance compensation spring can comprise a single spring or a plurality of springs of the above-mentioned type. It is also possible to equip a clearance compensation spring with four or more branches, it being possible for the clearance compensation spring to be closed in a peripheral direction.

Instead of having clearly defined branches, the clearance compensation spring can be configured to be round, at least in portions or possibly completely. In such a case, the spring portions can be allocated via the relevant clearance compensation. In preferred embodiments of the invention, the clearance compensation spring is configured in such a way that the plug connector can be centred relative to the counter connector when said plug connector is inserted into the counter connector or pushed through the clearance compensation spring. The preferably metallic clearance compensation spring can also be configured in such a way that it assumes an electromagnetic shielding function. That is to say, the clearance compensation spring can be a portion of a shield, for which purpose it is preferably closed in the peripheral direction. The clearance compensation spring can also be used to produce a shield contact, i.e. an electrically conductive connection between two shields can be established via the clearance compensation spring.

In embodiments of the invention, the clearance compensation spring comprises a base wall, a single side wall extending away from the base wall, preferably approximately perpendicular thereto, or two side walls extending away from two opposing ends of the base wall, preferably each approximately perpendicular thereto. That is to say, the clearance compensation spring is approximately L-shaped in cross-section in the first case and approximately U-shaped in cross-section in the second case. The base wall preferably comprises a disc spring or is formed as a disc spring. The base wall can also be formed as a leaf spring or, at least in portions, as a spring shackle. A side wall can be formed as an inwardly curved leaf spring, at least in part. Again, a spring shackle can also be used instead of a leaf spring.

In a preferred embodiment of the invention, the clearance compensation spring is approximately U-shaped in cross-section. In this case, the base wall comprises a disc spring, the base of which can be mounted in a recess of the counter connector or the support collar. The two side walls of the clearance compensation spring are formed as inwardly curved leaf springs, at least in part. In a further preferred embodiment of the invention, the clearance compensation spring is again approximately U-shaped in cross-section. However, the base wall is formed as a leaf spring or comprises two spring shackles which are interconnected, preferably in a materially integral manner. In this case, the base wall comprises a locking recess with which the clearance compensation spring is mounted on a projection of a wall in the counter connector or in the support collar. The two side walls are again formed as inwardly curved leaf springs, at least in part.

In both embodiments, in particular the connected ends of the side walls, i.e. a region of a respective transition of the relevant side wall into the base wall, can be formed in such a way that the clearance compensation spring is clamped in the counter connector or support collar by these regions, or the counter connector or the support collar is configured accordingly in a relevant region. This can also be applied to the free ends of the side walls of the clearance compensation spring, the free ends of the side walls of the clearance compensation spring then being clamped in the counter connector or support collar, at least when the clearance compensation spring is mounted but not otherwise under load, i.e. when the plug connector is not inserted. That is to say, the free ends and the base wall clamp the clearance compensation spring in the counter connector or the support collar.

It is also possible to provide one or more webs on an insertion opening of the counter connector or the support collar for the plug connector, behind which webs the clearance compensation spring can be mounted in the counter connector or in the support collar. In a mounted state, the web holds the clearance compensation spring in the counter connector or in the support collar in an axial direction, at least one portion of the clearance compensation spring disappearing behind the web, at least in part, in an end view of the counter connector or the support collar. That is to say, the clearance compensation spring can no longer fall out of the counter connector or the support collar in the axial direction counter to the insertion direction of the plug connector, since the web forms an undercut for the clearance compensation spring.

One side wall or both side walls of the clearance compensation spring comprise(s) a spring shackle which is preferably cut or punched out of said side wall(s). A spring shackle of this type is folded laterally inwards into the clearance compensation spring, a connected end of the spring shackle comprising the relevant side wall being arranged closer to a front end face of the spring shackle than the free end of said spring shackle which extends obliquely inwards and rearwards into the clearance compensation spring. As a result, the plug connector can be pushed counter to the insertion direction thereof, in which it can be inserted into the counter connector, by the spring shackle. In this case, a locking means of the plug connector is preferably pushed towards a locking means in the counter connector or the plug connector is moved in this direction. However, it is also possible to provide a limit stop in the counter connector or the support collar for this purpose.

In preferred embodiments of the invention, the clearance compensation spring comprises at least one insertion tongue projecting outwards therefrom which makes it possible to insert the plug connector into the counter connector or push the plug connector through the clearance compensation spring in a simple manner. The insertion tongue is preferably provided on the front end face of the clearance compensation spring in such a way that it projects laterally outwards from a side wall, the two side walls preferably each comprising an insertion tongue, in particular in the centre thereof. Of course, it is also possible, depending on the configuration of the clearance compensation spring and of the counter connector or the support collar, to provide insertion tongues in other positions on the clearance compensation spring. It is thus possible to provide or form one or more insertion tongues on a base wall or, if there is one, on a top wall of the clearance compensation spring. A relevant insertion tongue is preferably connected to the clearance compensation spring in a materially integral manner.

The invention is explained in greater detail below with reference to embodiments and to the accompanying drawings, in which.

Figure 1:
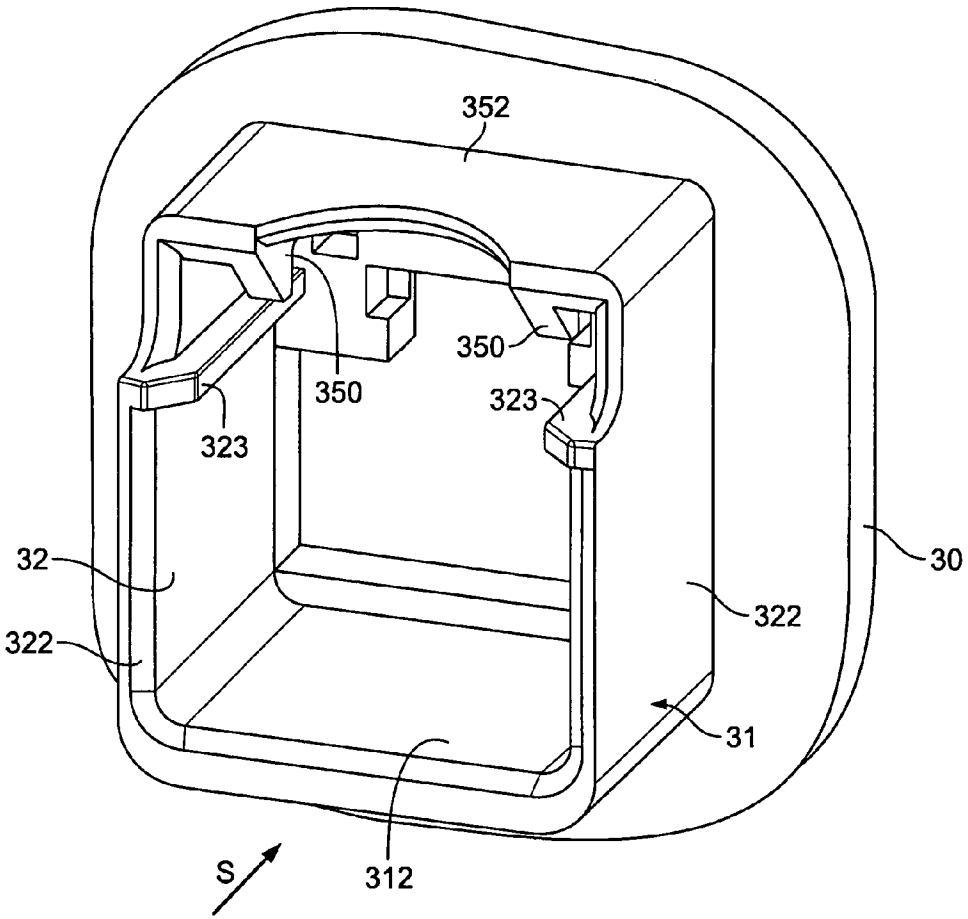
FIG. 1 is a perspective view of a support collar according to the prior art for an electrical plug connection.

The schematic FIG. 11 to 18 of the drawings show further embodiments of clearance compensation springs according to the invention, a large number of other configurations of the clearance compensation spring also being possible, which for reasons of clarity are not shown in the drawings.

FIG. 1 shows a support collar 31 according to the prior art on a housing wall 30 of an electrical or electronic device or an electrical or electronic appliance. The support collar 31 preferably serves as a secondary locking mechanism for locking an electrical plug connector in an electrical counter connector, the support collar 31 being a component of the counter connector or being associated therewith. For this purpose, the support collar 31 comprises at least one locking means 350, which is preferably formed as a locking hook 350 and extends inwards from a top wall 352 into the support collar 31. Correspondingly, the plug connector comprises a locking means which is preferably formed as a locking tongue, the locking tongue 100 resting against a portion of the locking hook 350 with clearance and thus locking the plug connector in the counter connector when the plug connector is inserted in the counter connector.

This is problematic because there is an axial, horizontal and vertical clearance or an axial, horizontal and vertical tolerance inside an electrical plug connection, i.e. three-dimensional clearance or tolerance between the plug connector and the counter connector. As a result, a plug connection of this type is not adapted for dynamic operating conditions in which forces act on the plug connection during the conventional use thereof. That is to say, as little mechanical shock loading and/or repeated mechanical loading as possible should act on the plug connection, because otherwise the plug connection would be damaged comparatively quickly.

In the following, the invention will be described in greater detail with reference to a clearance compensation unit or a clearance compensation spring for a support collar of a counter connector, formed as a socket connector, of a plug connection, in particular of an RJ plug connection. However, the invention is not limited to a plug connection of this type but can be applied in all cases where clearance compensation and/or tolerance compensation for the participating connectors is necessary in a plug connection. The invention is also not limited to a clearance compensation unit or a clearance compensation spring for a support collar. The clearance compensation unit according to the invention or the clearance compensation spring according to the invention can also be provided on/in a plug connector or on/in a counter connector without a support collar, or in a housing wall. In this context, a plug connector or a counter connector can be a plug, a built-in plug, a coupling, a (built-in) socket or the like.

Figure 3:
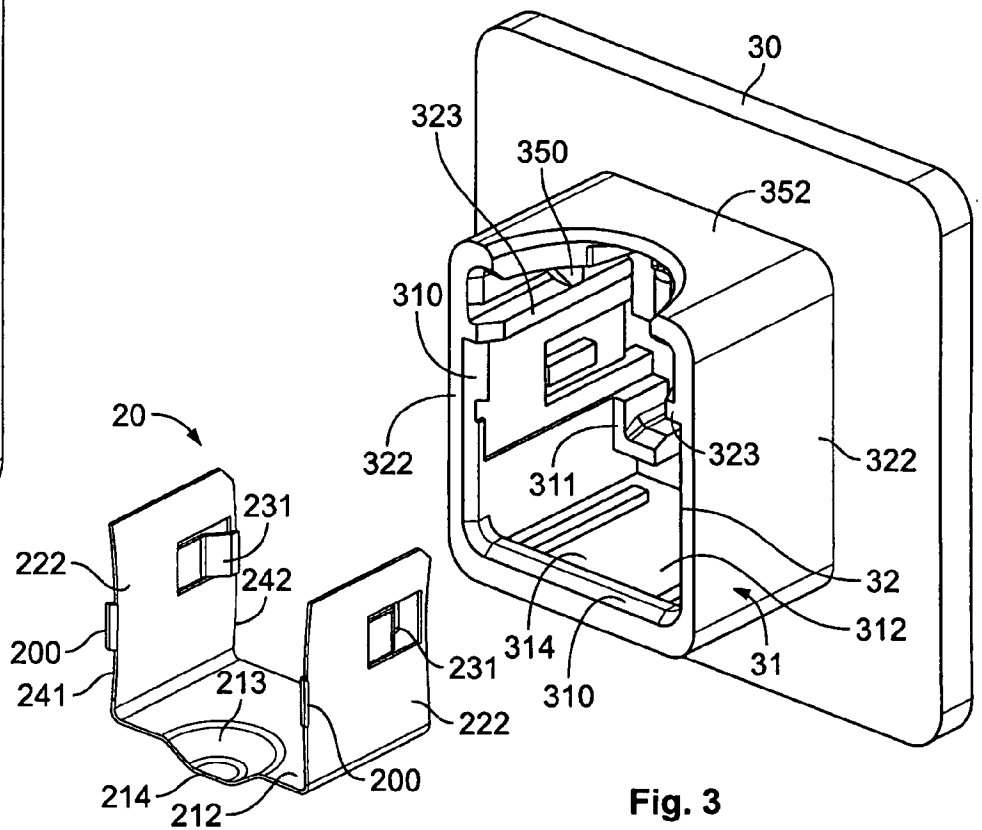
FIG. 3 is a 3D view, similar to FIG. 2, of the clearance compensation spring according to the invention, prior to mounting in the support collar.
Figure 2:
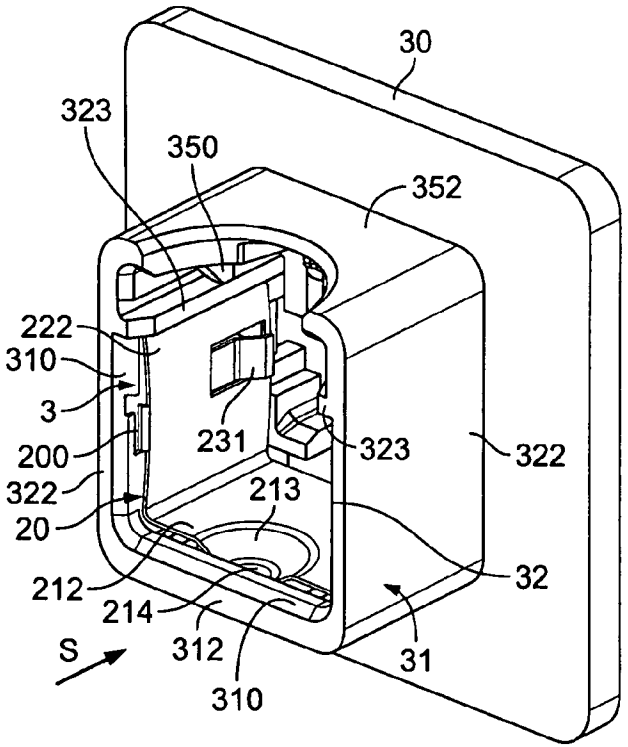
FIG. 2 is a perspective view of a support collar according to the invention with a clearance compensation spring according to the invention provided therein, according to a first embodiment of the invention.
Figure 4:
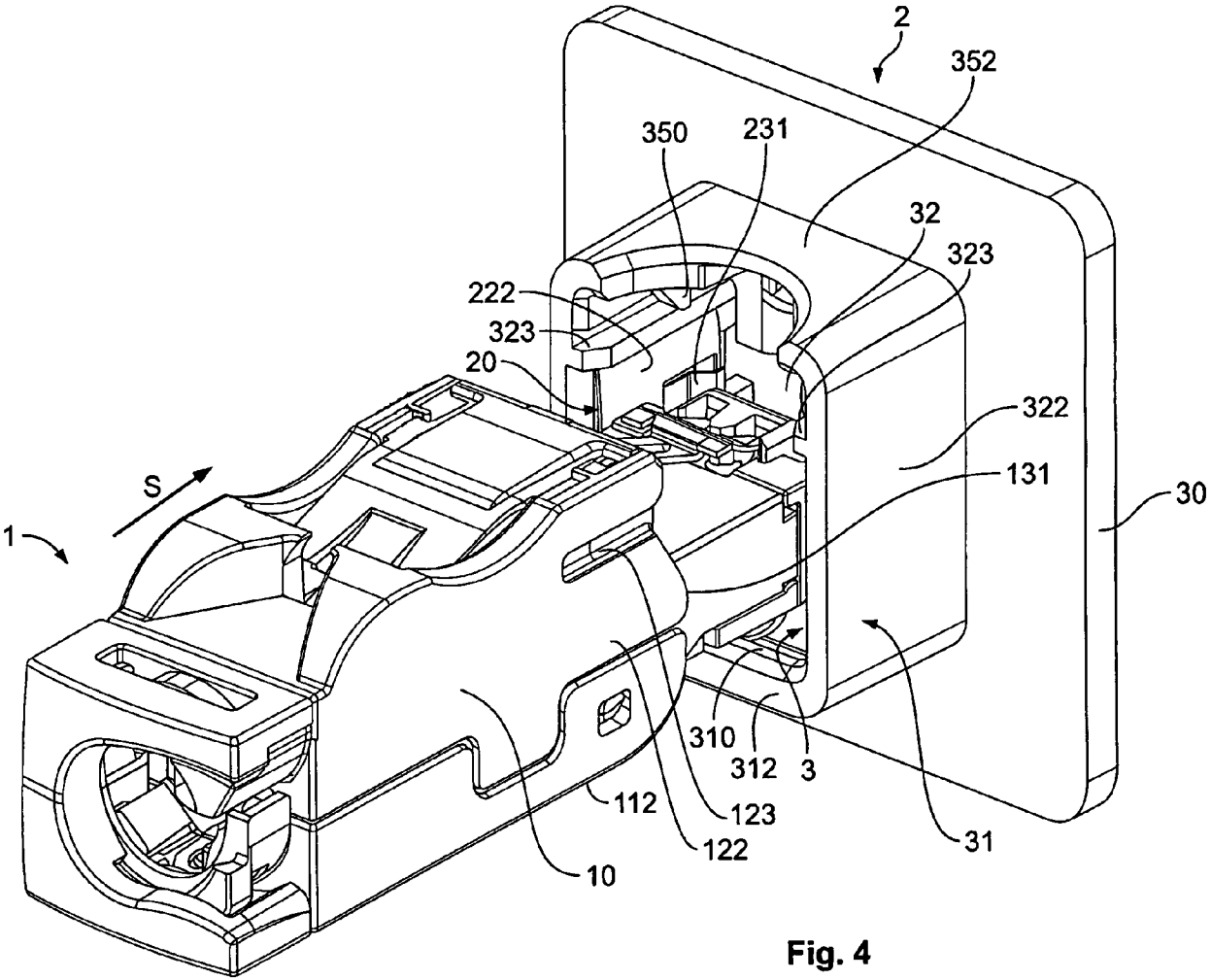
FIG. 4 is a perspective view of the mounting of an electrical plug connection according to the invention made up of a plug connector and a counter connector which comprises the support collar according to the invention.

FIG. 2 to 4 show the clearance compensation unit 3 according to the invention, which comprises the clearance compensation spring 20 according to the invention, which for example is formed as a cage spring 20 or a spring steel sheet 20, and corresponding mounting portions on/in a counter connector 2 or the support collar 31 thereof. In this case, the clearance compensation unit 3 or the clearance compensation spring 20 is constructed in such a way that clearance or tolerance of a plug connector 1 in the counter connector 2 can be reduced to substantially or approximately zero in preferably at least two dimensions, orientations or directions. In this case, it is possible to reduce the clearance or the tolerance to substantially or approximately zero in three dimensions, orientations or directions. For this purpose, the clearance compensation spring 20 surrounds a periphery of the plug connector 1 at least in portions when the plug connector is inserted in the counter connector 2, and pushes or moves the plug connector 1 against a portion of the clearance compensation spring 20 or against a portion inside the counter connector 2 or the support collar 31.

Figure 6:
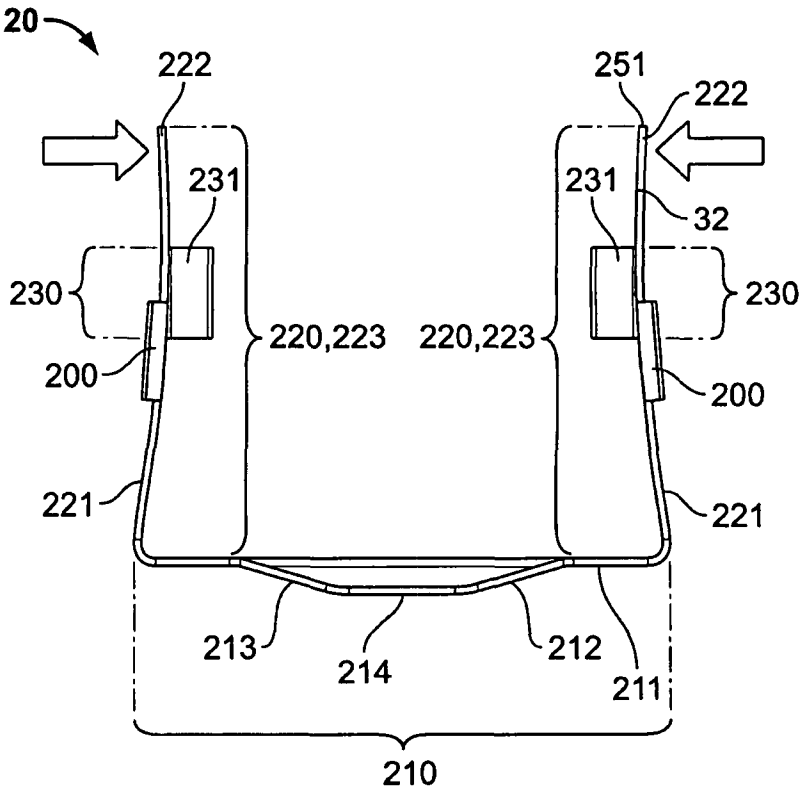
FIG. 6 is a view, similar to FIG. 5, of a mechanical reaction of the two side walls of the clearance compensation spring when the plug connector is pushed through them.
Figure 5:
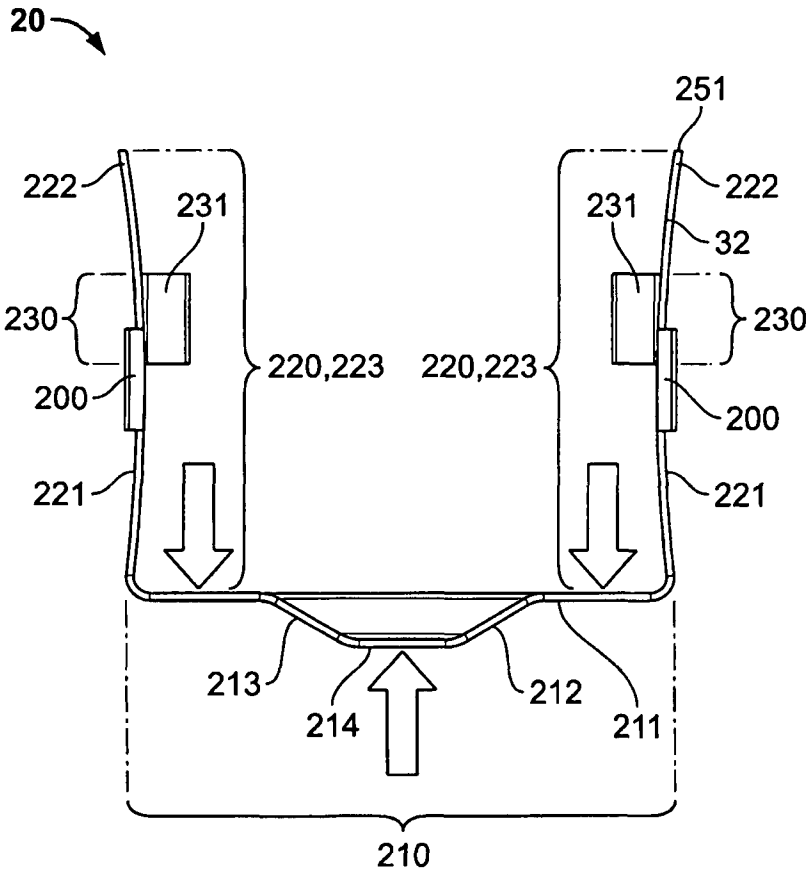
FIG. 5 is a sectional end view of a mechanical reaction of a base wall of the clearance compensation spring when the plug connector is pushed through it.
Figure 7:
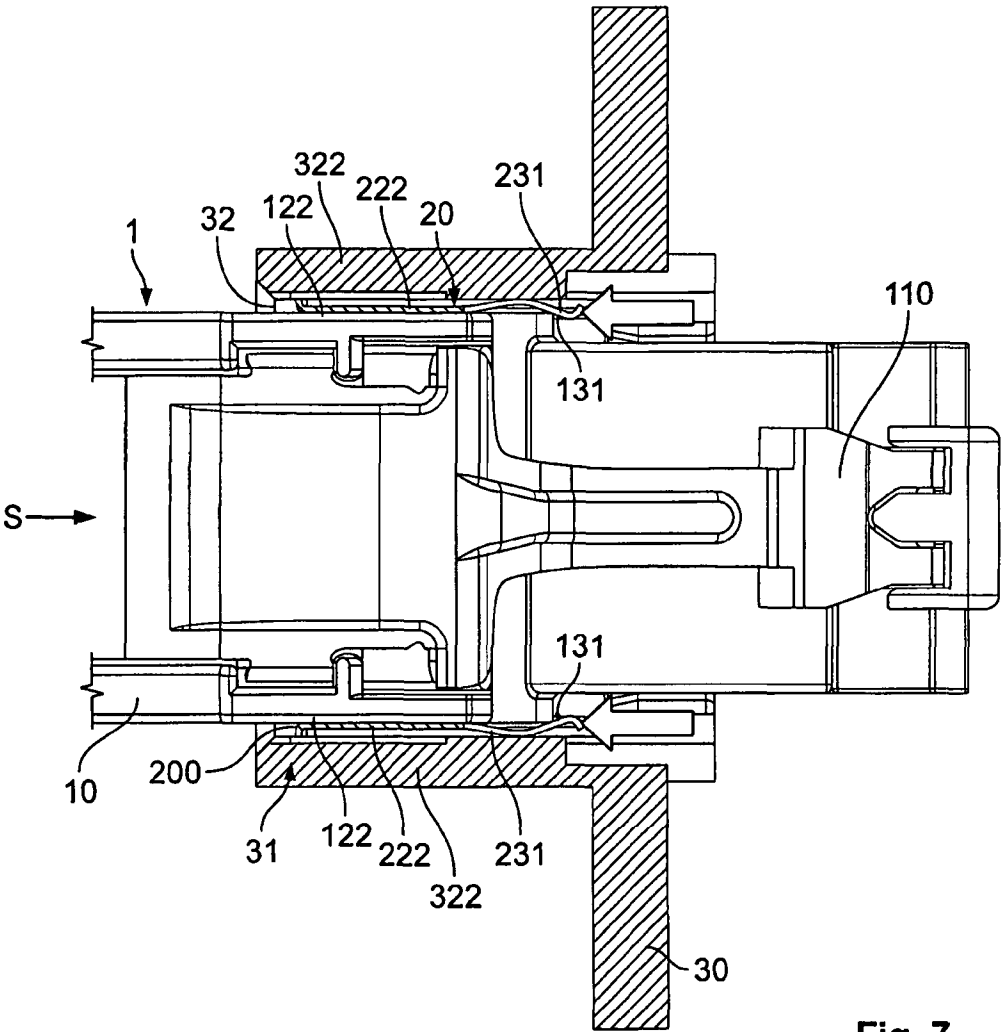
FIG. 7 is a partial sectional plan view of the mounted plug connection, an axial clearance compensation of the clearance compensation spring being shown.
Figure 8:
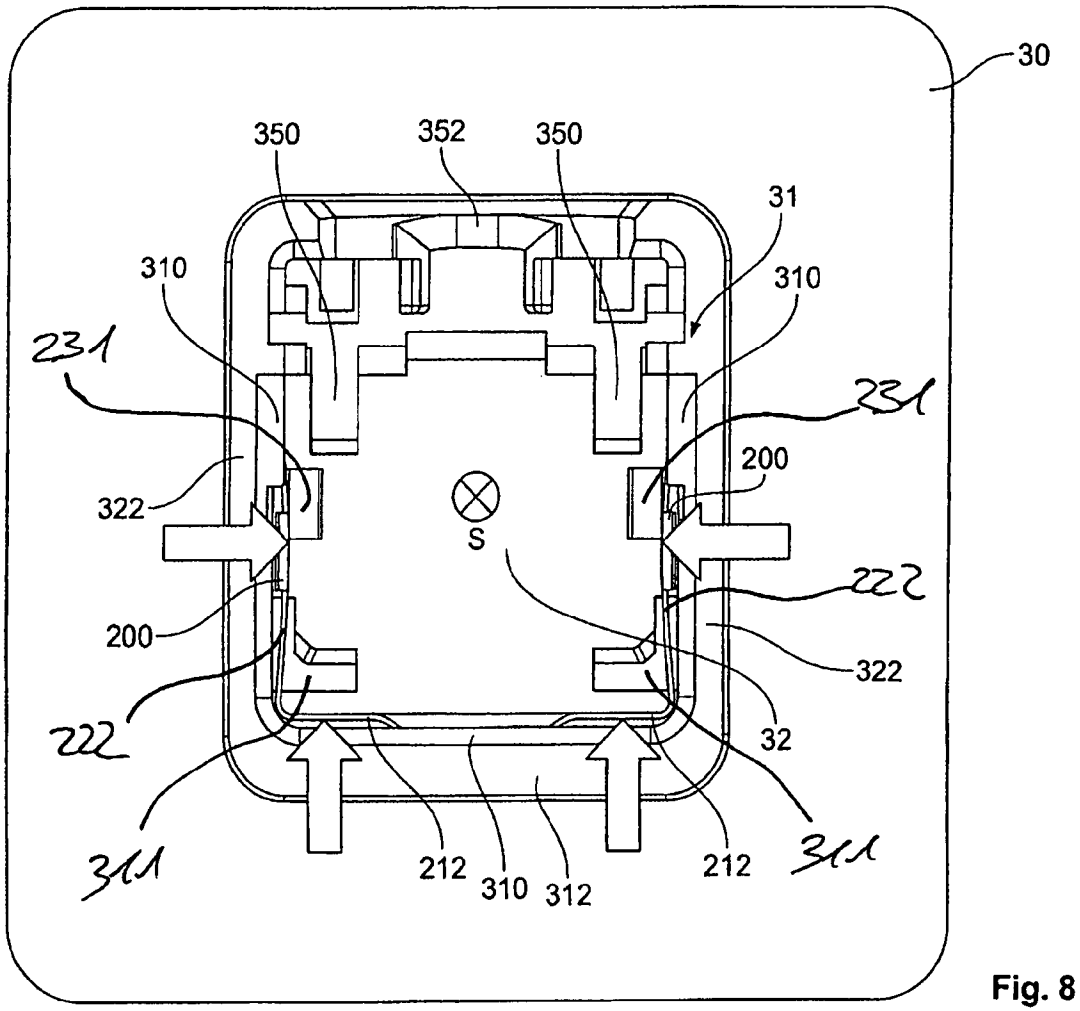
FIG. 8 is a front view of the support collar, a horizontal compensation and a vertical compensation of the clearance compensation spring being shown.

In this case, the clearance compensation spring 20 is fixed, preferably accommodated in a clamped manner, in the counter connector 2 or in the support collar 31, it only being possible for the plug connector 1 to move relative to the counter connector 2 once a respective spring constant of a spring portion 210, 220, 230 (see FIGS. 5 and 6) of the clearance compensation spring 20 has been overcome. It is also possible to accommodate the clearance compensation spring 20 in the counter connector 2 or in the support collar 31 in another manner. Thus it is possible, for example, to provide the clearance compensation spring 20 in a housing, in the support collar 31 or in a housing for the counter connector 2 in a moulding process, or to screw, rivet, clip or glue it thereto. The prospective spring portions 210, 220, 230 of the clearance compensation spring 20 are preferably formed so as to be planar, for which purpose for example a disc spring, a spring shackle, a leaf spring or a concave or convex curve of or in a relevant wall 212, 222 are respectively adapted.

The counter connector 2 or the support collar 31 preferably comprises a front web 310 or limit stop 310 and a rear web 311 or limit stop 311 for mounting the clearance compensation spring 20. In a mounted state, the front web 310 or limit stop 310 and the rear web 311 or limit stop 311 hold the clearance compensation spring 20 in position, at least in an axial dimension, i.e. a direction in which the plug connector 1 is inserted into the counter connector 2 and a direction in which it is removed therefrom. In this case, the relevant end face 241, 242 of the clearance compensation spring 20 rests, at least in portions, on the relevant web 310, 311 or limit stop 310, 311. The clearance compensation spring 20 can preferably be clamped in the counter connector 2 or support collar 31 by one or more relevant webs 310, 311 or limit stops 310, 311. In this case and also in other embodiments, it is preferred for the spring portions 220 not to be clamped in the counter connector 2 or support collar 31, so that they can move, in particular pivot, horizontally.

A clearance compensation spring 20 can comprise at least one, preferably two and in particular three spring portions 210, 220, 230 of this type for compensating clearance or tolerance in a single relevant dimension, orientation or direction in each case. In this case, an individual spring portion 210, 220, 230, i.e. a spring portion 210, 220, 230 for compensating clearance or tolerance in a single relevant dimension, orientation or direction, can be provided multiple times, for example twice, on/in the clearance compensation spring 20, as is the case in the following embodiment with the spring portions 220, 223. It is also possible to provide only a single spring portion 210; 220; 230-210, 220; 210, 230; 220, 230-210, 220, 230 or to form all these spring portions 210; 220; 230-210, 220; 210, 230; 220, 230-210, 220, 230 on/in the clearance compensation spring in duplicate.

In the following, a first embodiment of the clearance compensation spring 20 according to the invention will be described in greater detail with reference to FIG. 2 to 6, the clearance compensation spring 20 having three spring portions 210, 220, 230 for compensating clearance and/or tolerance in three dimensions. In this case, one spring portion 210 is provided and the spring portions 220, 230 are provided in duplicate, the spring portions 220, 230 being formed symmetrically about the spring portion 210 and in a materially integral manner therewith. A respective spring portion 230 is also connected to a spring portion 220 in a materially integral manner and provided symmetrically inside the clearance compensation spring 20. In this case, the single spring portion 210 and the two spring portions 220 form a web 210, which can also be referred to as a branch 210 of the clearance compensation spring 20, and two branches 220 projecting therefrom, resulting in an approximately U-shaped cross-section (see FIGS. 5 and 6). This U-shaped cross-section extends rearwards into the support collar 31 in the insertion direction S of the plug connector (see FIG. 1).

The first spring portion 210 forms a base wall 212, the two second spring portions 220 form two side walls 222 and the two third spring portions 230 form side wall regions of the clearance compensation spring 20, which side wall regions are cut free from the side walls 222 and project inwards into the cage-like clearance compensation spring 20. The cage-like clearance compensation spring 20 is preferably open, at least in part, in particular completely, on a front end face 241, on a rear end face 242 and on a top face 251. The respective spring portion 210, 220, 230 comprises a preferably planar spring or is itself formed as a preferably planar spring. A respective, also single, spring portion 210, 220, 230 compensates clearance and/or tolerance in vertical (spring portion 210), horizontal (spring portion 220) and axial (spring portion 230) dimensions. In this case, the spring paths of the respective spring portions 210, 220, 230 are calculated at least in such a way that an occurring maximum clearance and an additionally occurring maximum tolerance can be completely compensated in the corresponding dimension.

The base wall 212 of the clearance compensation spring 20 comprises a disc spring 213 for compensating clearance or tolerance, the base 214 of which disc spring rests in a recess 314 in a base wall 312 of the support collar 31 or is mounted therein. That is to say, the clearance compensation spring 20 is mechanically connected or coupled to the support collar 31 via the disc spring 213. A respective side wall 222 is formed as an inwardly curved side wall 222, at least in portions, the side walls 222 thus forming leaf springs. The side walls 222 can also be regarded as spring shackles 223 which are mounted on the base wall 212. In the present case, the third spring portion 230 is formed as a spring shackle 231 which is separated out from the respective second spring portion 220, the respective spring shackle 231 projecting obliquely inwards into the clearance compensation spring 20.

If the plug connector 1 is inserted into the counter connector 2 (see FIG. 2), an insertion face and a portion, located behind said insertion face, of the plug connector 1 initially pass through an insertion opening 32 of the support collar 31 and subsequently inside the clearance compensation spring 20, the clearance compensation spring 20 moving or preferably being plastically deformed when a plug connector body 10 is mounted in the support collar 31, as indicated by arrows in FIG. 5 to 8. In this case, it is preferred for a front portion or cross-section of the plug connector 1 to be smaller than an inner cross-section of the clearance compensation spring 20, in such a way that the plug connector 1 is able to deform the clearance compensation spring without difficulty and as desired, the clearance compensation spring 20 exerting forces (arrows) on the plug connector body 10 or the plug connector 1 in such a way that these forces position the plug connector 1 relative to the counter connector 2 without clearance or tolerance, at least in one dimension, orientation or direction.

When the plug connector 1 is inserted into the counter connector 2, said plug connector slides, together with a top wall of the plug connector body 10, along the inside of the top wall 352 of the support collar 31. An inner web 323 of a side wall 322 of the support collar 31 can also engage in a preferably lateral groove 123 of the plug connector body 10. In this case, the disc spring 213 of the base wall 212 is compressed by a base wall 112 of the plug connector 1 or of the plug connector body 10 and the top wall of the plug connector body 10 is pushed or moved against the top wall 352 of the support collar 31. Alternatively or in addition, a boundary of the groove 123 of the plug connector body 10 is pushed or moved against the inner web 323 of the relevant side wall 322. Clearance is thereby compensated in one dimension, in the present case in the vertical dimension. In this regard, see in particular FIGS. 5 and 8.

The clearance compensation spring 20 is designed in such a way that the two spring portions 220 of the clearance compensation spring 20 contract inwards when the plug connector body 10 or the plug connector 1 is inserted. Because the clearance compensation spring 20 is fixed in position in the support collar 31, clearance is compensated in a further dimension, in the present case in a horizontal dimension, the plug connector 1 also being centred relative to the counter connector 2 owing to the symmetrical arrangement of the spring portions 220. In this regard, see in particular FIGS. 6 and 8, the side walls 222 of the clearance compensation spring 20 resting against the side walls 122 of the plug connector 1 or the plug connector body 10 and clamping these between them. The clearance compensation spring 20 can also be designed in such a way that the two spring portions 220 contract inwards only slightly, or not at all, when the plug connector 1 is inserted. A correspondingly large curve of the two spring portions 220 can compensate this, in such a way that the above-described effect can nevertheless be achieved.

For compensating clearance and/or tolerance in a plug-in or insertion direction S of the plug connector 1 relative to the counter connector 2 (i.e. an axial compensation), the clearance compensation spring 20 comprises the spring portions 230 on its side walls 222, preferably on the resilient regions of the two side walls 222. That is to say, the spring portions 230 also move in the horizontal direction when the clearance compensation spring 20 contracts or expands. In the present case, a single spring portion 230 is configured as a spring shackle 231 which is preferably formed integrally with the relevant side wall 222. In this case, the spring shackle 231 is cut or punched out of the relevant side wall 222, thus preferably consisting of a portion of the relevant side wall 222 and extending towards the free end thereof in the plug-in direction S of the plug connector 1 and obliquely inwards into the clearance compensation spring 20, at least in portions.

If a contact region 131 of the connector 1 or of the connector body 10 for the spring portion 230 or spring shackle 231 comes into contact with the spring portion 230 or spring shackle 231, the plug connector 1 or plug connector body 10 pushes apart the spring portions 230 or spring shackles 231, which in turn exert a force, counter to the insertion direction S of the plug connector 1, on the plug connector 1 or plug connector body 10. For this purpose, the spring shackles 131 act obliquely on the relevant contact region 131. As a result, clearance is compensated in an additional dimension, in the present case in an axial dimension. In this case, the contact region 131 can be formed as a projection 131 or a shoulder 131 on the plug connector 1 or on the plug connector body 10. In this regard, see in particular FIG. 7. In the case of axial compensation, it is also preferred for a relevant third spring portion 230 to be moved together with, i.e. preferably provided on, another spring portion 210, 220 of the clearance compensation spring 20.

Figure 9:
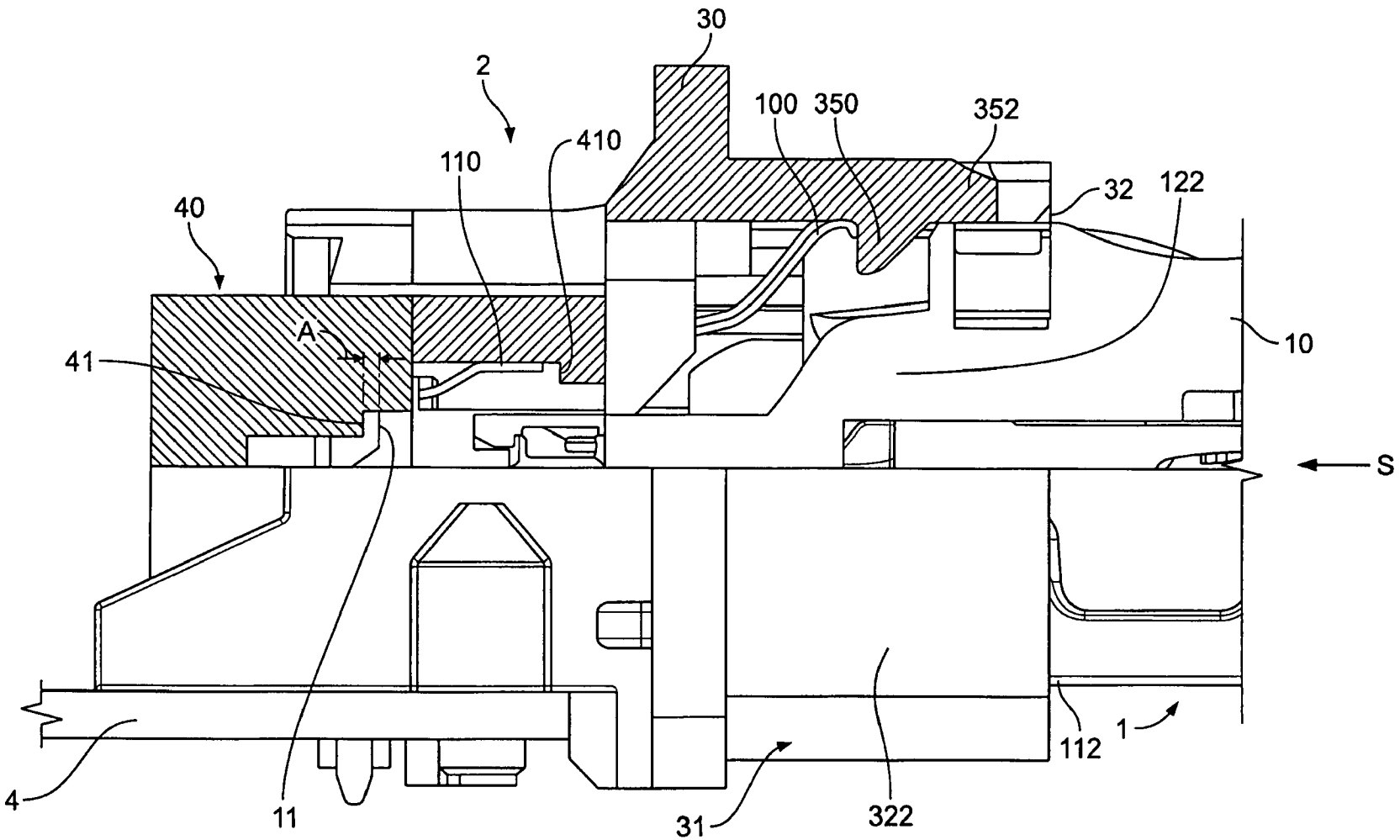
FIG. 9 is a partial sectional side view of the mounted plug connection according to the invention, made up of the plug connector and the counter connector.

Once the plug connector 1 is locked in the counter connector 2 (in this regard see in particular FIG. 9), preferably by means of a primary (see below) and a secondary (see above) locking mechanism, a locking means 110, 100 for the primary and/or secondary locking mechanism of the plug connector 1 is pushed permanently against a corresponding locking means 410, 350 in a socket 40 or in the support collar 31. This results in a spacing A or a gap A between a free end 11 of the plug connector 1 and a limit stop 41 inside the socket 40. The plug connector 1 is also pushed or moved permanently towards the top wall 352 and/or against the web 323 by the disc spring 213 of the base wall 212 of the clearance compensation spring 20, and is clamped in the clearance compensation spring 20 by the curved side walls 222 thereof, the clearance compensation spring itself being rigidly mounted in the support collar 31. In this case, the socket 40 is mounted on a substrate 4, for example a circuit board 4.

In the present case, primary locking of the plug connector 1 in the counter connector 2 is preferably achieved in the part of the counter connector 2 which is formed as a socket 40, which is preferably connected directly to the support collar 31 in the plug-in direction of the plug connector 1. For this purpose, the plug connector 1 and the counter connector 2 or the socket 40 again have locking means 110, 410 which correspond to one another and in the present case are preferably formed as locking tongues 110 of the plug connector and locking hooks 410 or locking shoulders 410 of the counter connector 2. In this case it is preferable, during sound clearance compensation by means of the clearance compensation spring 20, if the participating locking means 110, 410 or the participating locking shoulders of the primary locking mechanism do not rest against one another, but those of the secondary locking mechanism do (see FIG. 9).

The clearance compensation spring 20 or the insertion opening 32 of the support collar 31 can also comprise insertion tongues 200 (not shown) which make it easier to insert the plug connector 1 into the clearance compensation spring 20 and to push it therethrough in part. In this case, an insertion tongue 200 is provided on the front end face 241 of the clearance compensation spring 20 and extends forwards and outwards away from its connection to the clearance compensation spring 20, in such a way that it centres the plug connector 1 to be inserted relative to the clearance compensation spring 20, at least in part. Preferred positions for insertion tongues 200 are the side walls 222 of the clearance compensation spring 20. However, one or more insertion tongues 400 can also be provided on a base wall 212 or, if there is one, on a top wall 252 (see FIGS. 14 and 17; see also below) The relevant insertion tongues 200 are also preferably bent outwards using a radius.

Figure 10:
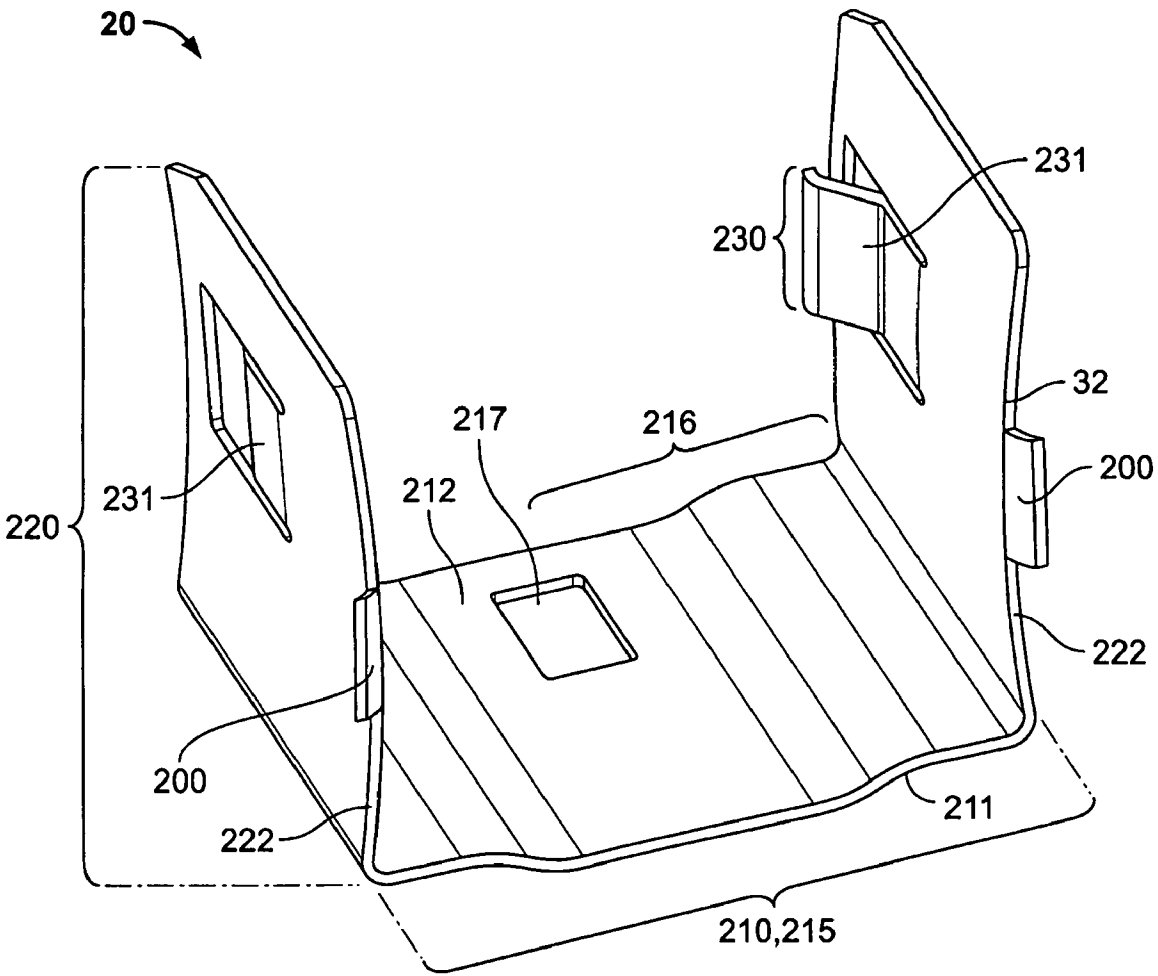
FIG. 10 is a perspective view of a second embodiment of the clearance compensation spring according to the invention.

FIG. 10 shows a second embodiment of the clearance compensation spring 20 according to the invention, the spring portions 220, 230 being formed as in the first embodiment. However, the base wall 212 of this clearance compensation spring 20 does not comprise a disc spring and is instead formed as a leaf spring 215. For mounting in the counter connector 2 or in the support collar 31, the clearance compensation spring 20 comprises, preferably in the base wall 212 thereof, a locking recess 217 which is preferably configured as a through-recess 217, a projection or a pin (not shown) engaging in the locking recess 217 when the clearance compensation spring 20 is mounted in the counter connector 2 or in the support collar 31. In this case, it is preferred for the leaf spring 215 to be formed in a planar manner in a central portion, in such a way that this portion of the clearance compensation spring 20 can fit in the counter connector 2 or in the support collar 31 in a planar manner. In this case, the portions of the base wall 212 which extend outwards away from the planar central portion can also be regarded as spring shackles 216. It is also possible, for example, for the base wall 212 to be formed as a curved wall, for example in the manner of a side wall 222, but without a third spring portion 230 (not shown).

Instead of the spring types mentioned directly above for the spring portions 210, 220, 230 of the two described embodiments, the spring types mentioned further above can also be used. In this regard, see also the explanations below relating to FIG. 11 to 18. FIGS. 11, 15, 16 and 18 show clearance compensation springs 20 for compensating clearance and/or tolerance in two dimensions, whereas FIG. 12 to 14 and FIG. 17 show clearance compensation springs 20 for compensating clearance and/or tolerance in three dimensions. In this case, the above-mentioned spring types can be applied to a spring portion 210, 220, 230, or said spring portion can be formed as a spring of this type virtually as desired. Disc springs are merely somewhat less well adapted for axial compensation than spring shackles. A plurality of additional combinations which are not shown in the drawings are also possible.

FIG. 11 to 14 further show clearance compensation springs 20 having walls with a concave curve, spring shackles on a relevant concave wall providing axial compensation in FIG. 12 to 14. In addition, FIG. 12 to 14 show insertion tongues 200 on a base wall (FIG. 12), on the side walls (FIG. 13) or on all the walls (FIG. 14). FIG. 15 to 17 show clearance compensation springs 20 having an assortment of walls, at least one wall having a concave curve and at least one other wall having a convex curve. In this case, the convex portions of the relevant walls can be formed as disc springs. Again, an axial compensation (FIG. 17) or insertion tongues 200 can be provided (FIGS. 16 and 17). FIG. 18 shows a single curved wall having an axial compensation and an insertion tongue 200. In addition, it is also conceivable, for example, for a spring portion 210, 220 to be formed as a spring shackle, or for a base wall or a top wall to be formed as a curved wall (not shown).

The invention claimed is:

1. Clearance compensation unit for a plug connection in particular an electrical RJ plug connection, comprising a plug connector and a counter connector, wherein the clearance compensation unit comprises a clearance compensation spring which has at least two spring portions in such a way that clearance between the plug connector and the counter connector can be compensated in at least two of three axes by means of the spring portions, it being possible to push the plug connector against another spring portion of the clearance compensation spring or against a limit stop of the counter connector.

2. Clearance compensation unit according to claim 1, wherein in each case at least one spring portion of the clearance compensation spring is provided to compensate clearance in a particular orientation, and clearance between the plug connector and the counter connector can preferably be compensated in three axes, approximately perpendicular to one another, by means of the spring portions.

3. Clearance compensation unit according to claim 1, wherein one relevant spring portion of the clearance compensation spring is a planar spring portion, and one spring portion preferably comprises a disc spring, a spring shackle, a leaf spring, or a concave or convex curve, and/or one spring portion is preferably formed as a disc spring, spring shackle, leaf spring, or concave or convex curve.

4. Clearance compensation unit according to claim 1, wherein a cross-section of the clearance compensation spring is preferably formed so as to be approximately I-, L- or U-shaped or closed and/or is in the form of a partial circle or a partial ellipse, at least in portions, and the clearance compensation spring is preferably configured as a single-piece cage spring which is open at least at the two end faces thereof and preferably also at the top face thereof, the clearance compensation spring preferably being formed symmetrically, in such a way that the plug connector can be centred when it is inserted into the clearance compensation spring or the counter connector.

5. Clearance compensation unit according to claim 1, wherein the clearance compensation spring comprises a base wall from which a side wall preferably extends approximately at right angles, or from two opposing sides of which two side walls preferably extend at right angles, the base wall comprising a disc spring or being formed as a disc spring, or the base wall being formed as a leaf spring or, at least in portions, as a spring shackle, and the side wall being formed as an inwardly curved leaf spring or the side walls being formed as inwardly curved leaf springs.

6. Clearance compensation unit according to claim 1, wherein the clearance compensation spring is configured to be approximately U-shaped in cross-section comprising a base wall and two side walls, and the base wall comprises a disc spring, the base of which is mounted in a recess of the counter connector, and the two side walls of the clearance compensation spring are formed as inwardly curved leaf springs, at least in part.

7. Clearance compensation unit according to claim 1, wherein the clearance compensation spring is configured to be approximately U-shaped in cross-section comprising a base wall and two side walls, and the base wall is formed as a leaf spring or is made up of two interconnected spring shackles, and the base wall comprises a locking recess with which the clearance compensation spring is mounted on a projection of a wall in the counter connector, and the two side walls of the clearance compensation spring are formed as inwardly curved leaf springs, at least in part.

8. Clearance compensation unit according to claim 1, wherein a side wall of the clearance compensation spring has a spring shackle which is preferably cut or punched out of said side wall, in such a way that the plug connector can be pushed counter to the insertion direction thereof, in which it can be inserted into the counter connector, by the spring shackle, it preferably being possible to push a locking means of the plug connector against a locking means of the counter connector.

9. Clearance compensation unit according to claim 1, wherein the clearance compensation spring comprises at least one insertion tongue, which projects outwards away from the clearance compensation spring, for simple insertion of the plug connector into the counter connector, the insertion tongue preferably being provided on a front end face of the clearance compensation spring in such a way that it projects laterally outwards from a side wall, and the two side walls preferably each comprising an insertion tongue, in particular in the centre thereof.

10. Plug connector; counter connector; in particular a plug, built-in plug, coupling or socket; a housing therefor; or a support collar; preferably for an electrical RJ plug connection, comprising a clearance compensation unit according to claim 1.

11. Clearance compensation unit according to claim 1, wherein the axes include horizontal, vertical and axial.

12. Clearance compensation unit for a plug connection in particular an electrical RJ plug connection, comprising a plug connector and a counter connector, wherein the clearance compensation unit comprises a clearance compensation spring which has at least two spring portions in such a way that clearance between the plug connector and the counter connector can be compensated in at least two dimensions by means of the spring portions, it being possible to push the plug connector against another spring portion of the clearance compensation spring or against a limit stop of the counter connector, wherein the clearance compensation spring is configured to be approximately U-shaped in cross-section, and a base wall of the U-shaped clearance compensation spring comprises a first spring, and two side walls of the U-shaped clearance compensation spring are formed as second springs.

13. Clearance compensation unit according to claim 12, wherein the two side walls of the U-shaped clearance compensation spring base wall are formed at least in part as inwardly curved leaf springs.

14. Clearance compensation unit according to claim 13, wherein the U-shaped clearance compensation spring base wall comprises a disc spring, the base of which is mounted in a recess of the counter connector.

15. Clearance compensation unit according to claim 12, wherein the U-shaped clearance compensation spring base wall is formed as a leaf spring or is made up of two interconnected spring shackles.

16. Clearance compensation unit according to claim 15, wherein the base wall comprises a locking recess with which the clearance compensation spring is mounted on a projection of a wall in the counter connector.

17. Clearance compensation unit according to claim 12, wherein the clearance compensation spring comprises at least one insertion tongue, which projects outwards away from the clearance compensation spring, for simple insertion of the plug connector into the counter connector.

18. Clearance compensation unit according to claim 17, wherein the insertion tongue preferably being provided on a front end face of the clearance compensation spring in such a way that it projects laterally outwards from a side wall.

19. Clearance compensation unit according to claim 18, wherein each of the two side walls comprises an insertion tongue.

20. Clearance compensation unit according to claim 12, wherein the clearance between the plug connector and the counter connector can be compensated in at least two of three coordinate axes by means of the spring portions.

* * * * *